US005813551A

United States Patent [19]

Abel

[11] Patent Number: 5,813,551

[45] Date of Patent: Sep. 29, 1998

[54] CRANE VEHICLE

[75] Inventor: Peter Abel, Mengen, Germany

[73] Assignee: Liebherr-Werk Ehingen GmbH, Ehingen/Donau, Germany

[21] Appl. No.: 764,251

[22] Filed: Dec. 12, 1996

[30] Foreign Application Priority Data

Dec. 14, 1995 [DE] Germany ..... 295 19 871 U

[51] Int. Cl.[6] ..... B66C 15/06

[52] U.S. Cl. ..... 212/278; 212/277

[58] Field of Search ..... 212/277, 278

[56] References Cited

U.S. PATENT DOCUMENTS

| | | | |
|---|---|---|---|
| 3,824,578 | 7/1974 | Harders | 212/277 |
| 5,119,949 | 6/1992 | Kishi | 212/277 |
| 5,160,056 | 11/1992 | Yoshimatsu et al. | 212/277 |
| 5,217,126 | 6/1993 | Hayashi et al. | 212/277 |

*Primary Examiner*—Thomas J. Brahan
*Attorney, Agent, or Firm*—Dilworth & Barrese

[57] ABSTRACT

The present invention relates to a crane vehicle with a jib, preferably a telescoping jib, hinged to its superstructure which jib can be luffed by a luffing ram which is hinged to the jib and the superstructure, with extending sliding beams which are positioned at the end parts of the longitudinal sides of the carrier which face each other and which are provided at their ends with extending stabilizer bases, and with an overload safety unit which generates a signal and/or stops the crane operation when the crane reaches or exceeds limits which endanger its stability. In accordance with the invention a monitoring unit is provided which detects the extension state of the sliding beams and which feeds the signals corresponding to the relevant extension state of the individual sliding beams to the overload safety unit and the overload safety unit assumes the lowest extension length of one of the sliding beams for all sliding beams to determine the limits which endanger the stability.

18 Claims, 3 Drawing Sheets

CRANE VEHICLE

BACKGROUND OF THE INVENTION

The present invention relates to a crane vehicle with a jib, preferably a telescoping jib, hinged to its superstructure which jib can be luffed by means of a luffing ram which is hinged to the jib and the superstructure, with extending sliding beams which are positioned at the end parts of the longitudinal sides of the carrier which face each other and which are provided at their ends with extending stabilizer bases, and with an overload safety unit which generates a signal and/or stops the crane operation when the crane reaches or exceeds limits endangering its stability.

The stability of a crane vehicle with telescoping jib depends in addition to the size of the load hanging from the telescoping jib among other things on the luffing angle and the extension length of the telescoping jib, on the sag of the telescoping jib and in particular also on the angle of rotation of the superstructure with the telescoping jib relative to the carrier and on the stand rectangle defined by the stabilizer bases of the sliding beams. With regard to the stand rectangle defined by the extended sliding beams and stabilizer bases the stability of the crane is greatest when the jib points in the direction of the sliding beam extended the furthest. When the sliding beams are retracted and the stabilizer bases extended the stability is greater in the longitudinal direction of the carrier than in the direction of its transverse axis. The overload protection must therefore always take into account the extension state of the sliding beams, which can be difficult to the extent that the stability also changes with different extension lengths of individual sliding beams.

SUMMARY OF THE INVENTION

It is therefore the object of the present invention to provide a crane vehicle of the type described above in which the overload safety unit takes into account the different extension lengths of the sliding beams in a simple and reliable manner.

In accordance with the invention this object is solved for a crane vehicle of the type described above by providing a monitoring unit which detects the extension state of the sliding beams and which feeds the signals corresponding to the relevant extension state of the individual sliding beams to the overload safety unit and by the overload safety unit assuming the shortest extension length of one of the sliding beams for all sliding beams to determine the limits which endanger the stability.

The invention is based on the fact that to determine the limits which endanger the stability of a crane, it is always safe and reliable to always assume, irrespective of the different extension lengths of the sliding beams, only the shortest extension length of a sliding beam, which is then used as a basis for the other sliding beams as well irrespective of the longer extension lengths so that only a smaller stand rectangle is taken into account than is possibly given due to the longer extension lengths of individual sliding beams. This means that when determining the safety against overturning only the smallest extension length of one of the sliding beams is taken into account so that the required stability is also ensured when the jib points in the direction of the sliding beam with the shortest extension length with the greater stabilities in the direction of the sliding beams with longer extension lengths not being taken into account.

In addition, a unit monitoring the bolting of the sliding beams can be provided which emits a signal to a central monitoring unit, when a sliding beam is not bolted.

BRIEF DESCRIPTION OF THE INVENTION

In the following an embodiment of the invention is shown in greater detail by means of the drawing in which:

FIGS. 1*a* to 1*c* show a top view of the carrier of a crane vehicle with differently extended sliding beams in a schematic representation; and FIGS. 2*a* to 2*c* show the detection of differently extended sliding beams for the determination of stability in a schematic representation; and FIGS. 3 is a schematic view illustrating conventional crane features.

DESCRIPTION OF THE PREFERRED EMBODIMENTS

In FIG. 1 a carrier 1 of a crane vehicle is shown schematically from which sliding beams 2 can be extended carrying at their ends stabilizer bases 3 which can be extended towards the ground at right angles to the sliding beams in a vertical direction by means of hydraulic cylinders. The sliding beams 2 are positioned at the end parts of the two longitudinal sides of the carrier 1 and can be extended at right angles to its longitudinal middle plane.

In the embodiment shown the sliding beams can be extended in three stages, in each of which they must be bolted in their guideways.

Figure 1A:
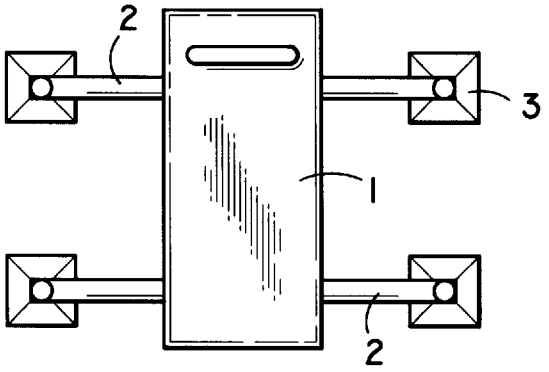

In FIG. 1*a* all sliding beams with their maximum extension lengths can be seen.

Figure 1B:
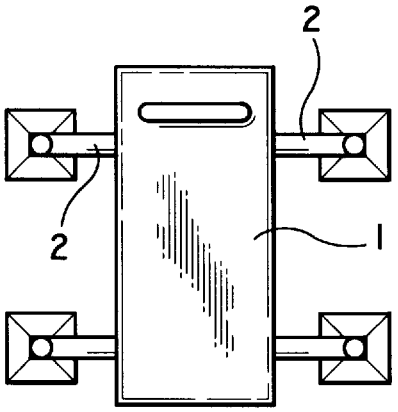

In the extension state shown in FIG. 1*b* the sliding beams 2 are in their middle extension state.

Figure 1C:
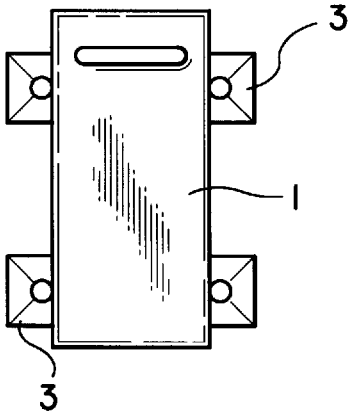

In FIG. 1*c* the sliding beams can be seen with their minimum extension lengths or in their retracted state in which the stabilizer bases also rest on the ground for their support.

Due to given local conditions it may be the case that single sliding beams cannot be extended to their full length. This can, for example, be due to the fact that obstacles, such as buildings, are in the way or that shorter extension lengths have to be chosen to obtain a sufficiently firm ground.

Figure 2A:
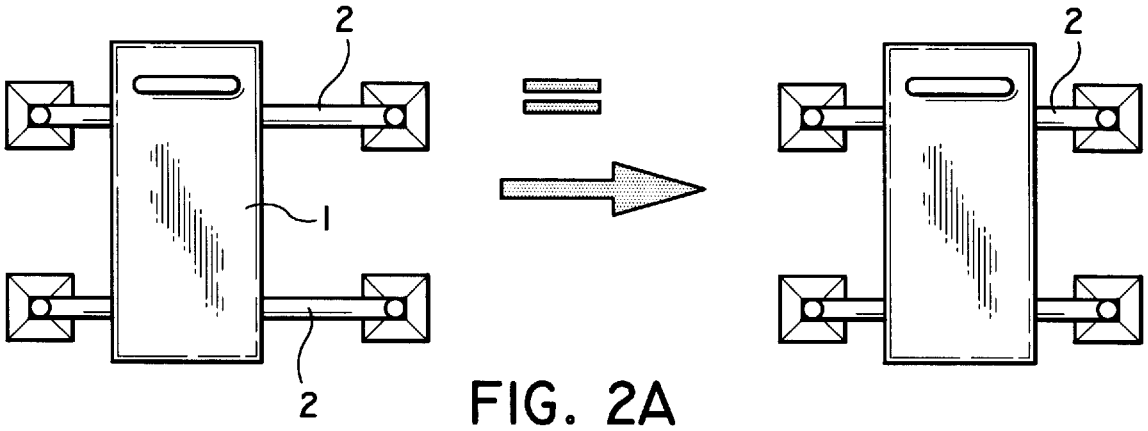
Figure 2B:
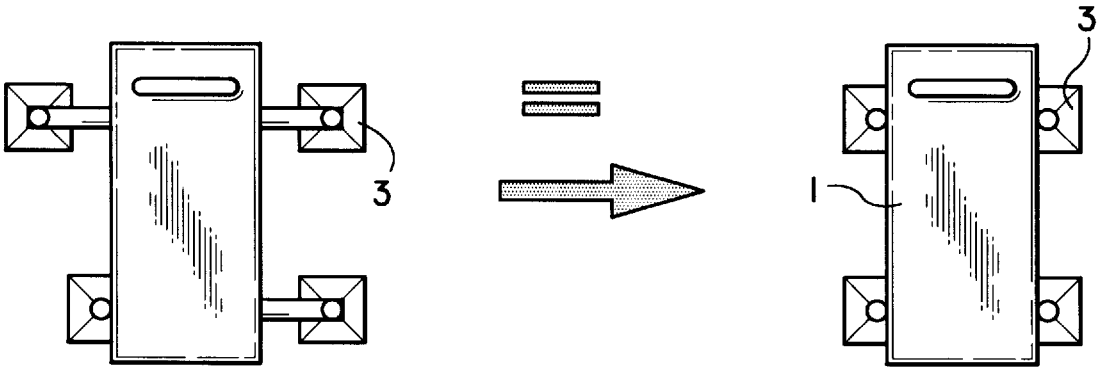
Figure 2C:
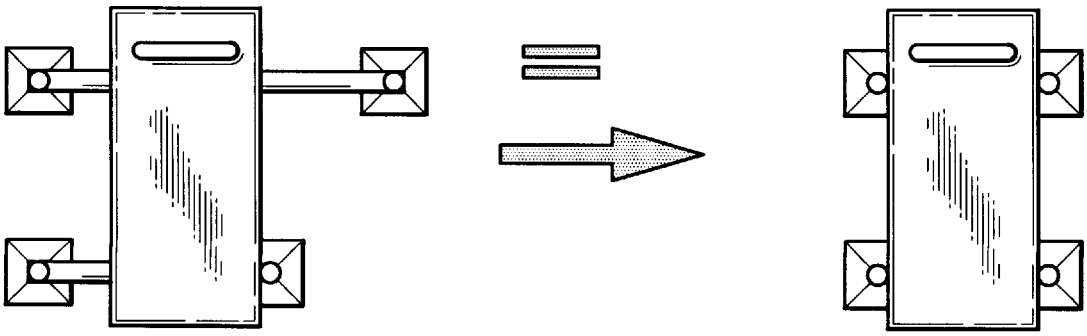
Figure 3:
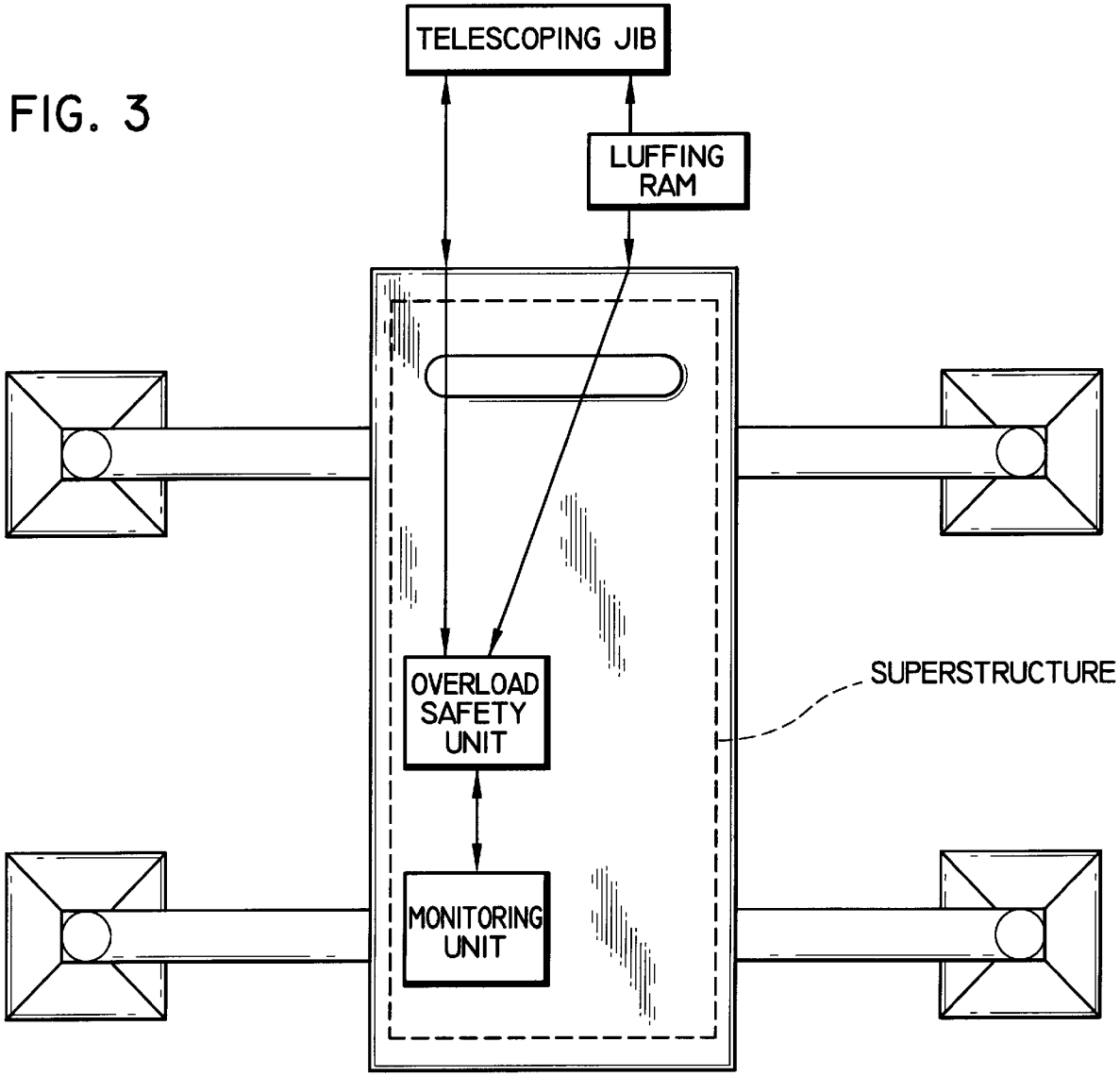

In the lefthand column of FIG. 2 three states are shown in which the individual sliding beams of the crane vehicle are extended to different lengths.

In the embodiment shown in FIG. 2 the sliding beams positioned on the lefthand side of the vehicle are extended up to their middle position, while the sliding beams positioned on the right side are fully extended. To determine the stability a state is assumed where all sliding beams are extended only to their middle positions as can be seen from the righthand sketch of FIG. 2*a*.

In the lefthand columns of the two lower embodiments of FIG. 2 the sliding beams are again extended to different lengths with one sliding beam 2 being extended to its shortest extension length or in its retracted state in each case. To determine the stand rectangle which must be taken into account for safety considerations a state is therefore assumed, as can be seen from the righthand side of FIG. 2, where all sliding beams are in their retracted states.

I claim:

1. A crane vehicle provided with a jib hinged to a superstructure mounted upon a carrier, which jib can be luffed by means of a luffing ram which is hinged to the jib and the superstructure, extending sliding beams which are positioned at end parts of longitudinal sides of the carrier which face each other and which are provided at the ends thereof with extending stabilizer bases, and an overload safety unit which takes at least one of the following actions (i) and (ii):

(i) generates a signal, and (ii) stops crane operation, when the crane reaches or exceeds limits endangering its stability, wherein the sliding beams are arranged to be extended to at least three stages, in each stage of which the beams are arranged to be locked in place to secure the same in the respective stage, a monitoring unit is provided which detects the extension state of the sliding beams and which feeds signals corresponding to the relevant extension state of the individual sliding beams to the overload safety unit, and the overload safety unit assumes extension length of a particular sliding beam extended the shortest, as the extension state of all of the sliding beams, to determine the limits which endanger the stability.

2. A crane vehicle in accordance with claim 1, wherein a unit monitoring the locking of the sliding beams in place is provided which emits a signal to the monitoring unit, when a sliding beam is not locked in place.

3. A crane vehicle in accordance with claim 2, wherein the jib is a telescoping jib.

4. The crane vehicle in accordance with claim 3, wherein the superstructure is rotatably mounted on the carrier.

5. A crane vehicle in accordance with claim 2, wherein the superstructure is rotatably mounted on the carrier.

6. A crane vehicle in accordance with claim 1, wherein the jib is a telescoping jib.

7. The crane vehicle in accordance with claim 6, wherein the superstructure is rotatably mounted on the carrier.

8. A crane vehicle in accordance with claim 1, wherein the superstructure is rotatably mounted on the carrier.

9. System for detecting extension state of extendable sliding beams provided on a crane vehicle for supporting the same and positioned at ends of longitudinal sides of a carrier for the vehicle facing each other, with stabilizer bases being provided at respective ends of the beams, comprising means for extending the sliding beams to at least three stages and, in each respective stage, locking the beams in place to secure the same, a monitoring unit arranged to detect extension state of all sliding beams, an overload safety unit coupled to the monitoring unit to receive signals from the monitoring unit on the extension state of the individual sliding beams, the overload safety unit arranged to assume length of a particular sliding beam extending the shortest of all of the sliding beams as a limit endangering stability, and the overload safety unit arranged to take at least one of the following actions (i) and (ii):

(i) generate a signal, and (ii) stop crane operation, when the crane reaches or exceeds the determined limit endangering stability.

10. System according to claim 9, wherein the crane comprises a telescoping jib mounted upon a superstructure, in turn, mounted upon the carrier.

11. System according to claim 10, wherein factors relating to the crane reaching or exceeding the determined limit endangering stability which are programmed into the overload safety unit, include amount of load hanging from the jib, luffing angle of the jib, extension length of the jib, sag of the jib, angle of rotation of the superstructure which is rotatably mounted upon the carrier relative to the carrier, and stand rectangle defined by the stabilizer bases at the end of the respective sliding beams.

12. System in accordance with claim 11, wherein stability of the carrier is greatest when the jib points in a direction of a sliding beam extending the greatest, and when all sliding beams are retracted, the stability is greatest in a longitudinal direction of the carrier than in a direction of a transverse axis thereof.

13. System in accordance with claim 12, comprising four sliding beams, two pairs extending from opposite sides of the carrier and carrying at the ends thereof the stabilizer bases which are extendable in a vertical direction towards ground and at right angles to the sliding beams, by hydraulic cylinders, the sliding beams being positioned at the ends of the longitudinal sides of the carrier and extendable at right angles to a longitudinal middle plane thereof.

14. Method for detecting extension state of extendable sliding beams provided in a crane vehicle for supporting the same and positioned at ends of longitudinal sides of a carrier for the vehicle facing each other, with stabilizer bases being provided at respective ends of the sliding beams, comprising the steps of extending the sliding beams to at least three stages, locking the beams in place in each respective stage to secure the same, determining length of a particular sliding beam extended the shortest of all the sliding beams, as a limit endangering stability, and taking at least one of the following steps (i) and (ii):

(i generating a signal, and (ii) stopping crane operation, when the crane reaches or exceeds the determined limit endangering stability.

15. Method in accordance with claim 14, wherein the crane comprises a telescoping jib mounted upon a superstructure, in turn, mounted upon the carrier.

16. Method in accordance with claim 15, comprising the additional step of taking into account factors relating to the crane reaching or exceeding the determined limit endangering stability, including amount of load hanging from the jib, luffing angle of the jib, extension length of the jib, sag of the jib, angle of rotation of the superstructure rotatably mounted upon the carrier relative to the carrier, and stand rectangle defined by the stabilizer bases of the respective sliding beams.

17. Method in accordance with claim 16, wherein stability of the carrier is greatest when the jib points in a direction of a sliding beam extended the greatest, and when all sliding beams are retracted, the stability is greatest in a longitudinal direction of the carrier than in a direction of a transverse axis thereof.

18. Method in accordance with claim 17, wherein the crane comprises four sliding beams with two pairs extending from opposite sides of the carrier and the sliding beams carrying at the ends thereof the stabilizer bases which can be extended towards ground in a vertical direction by hydraulic cylinders and at right angles to the respective sliding beams, the sliding beams being positioned at the ends of the longitudinal sides of the carrier and extendable at right angles to a longitudinal middle plane thereof.

* * * * *